US005522558A

United States Patent [19]

Kaneko

[11] Patent Number: 5,522,558

[45] Date of Patent: Jun. 4, 1996

[54] CONTINUOUS TYPE VERTICAL PLANETARY BALL MILL

[75] Inventor: Kantaro Kaneko, Osaka, Japan

[73] Assignee: Kurimoto, Ltd., Osaka, Japan

[21] Appl. No.: 226,340

[22] Filed: Apr. 12, 1994

[30] Foreign Application Priority Data

Dec. 17, 1993 [JP] Japan ..... 5-344126

[51] Int. Cl.[6] ..... B02C 17/08

[52] U.S. Cl. ..... 241/171; 241/175

[58] Field of Search ..... 241/57, 70, 171, 241/175, 208

[56] References Cited

U.S. PATENT DOCUMENTS

| | | | |
|---|---|---|---|
| 2,916,218 | 12/1959 | Werner | 241/208 |
| 2,937,814 | 5/1960 | Joisel | 241/175 |
| 3,201,273 | 8/1965 | Maker et al. | 241/175 |
| 3,529,780 | 9/1970 | Wilkinson, Jr. | 241/175 |
| 4,090,671 | 5/1978 | Kartman | 241/29 |
| 4,955,551 | 9/1990 | Jurisov | 241/175 |
| 5,232,169 | 8/1993 | Kaneko et al. | 241/57 |

FOREIGN PATENT DOCUMENTS

| | | |
|---|---|---|
| 440245 | 2/1992 | Japan . |
| 417837 | 2/1992 | Japan . |
| 5146698 | 6/1993 | Japan . |

*Primary Examiner*—Mark Rosenbaum
*Assistant Examiner*—John M. Husar
*Attorney, Agent, or Firm*—Jones, Tullar & Cooper

[57] ABSTRACT

This present invention intends to provide a continuous type vertical planetary ball mill performing with high efficiency. In this ball mill, a mill pot is provided with an entrance and an exit which are vertically open. The entrance communicates with a charging port of a charging case which rotates together with a revolving rotary body, and the exit communicates with a discharging case fixed to a bed so as to allow only fine particles to pass through. Compressed air is supplied to bearings interposed between an airtight chamber and a fixed shaft, between the airtight chamber and a rotary shaft, and between the airtight chamber and a mill casing. As a result, this continuous type vertical planetary ball mill is stable in construction as compared with the conventional vertical type of ball mill and enables a high speed operation. Crushing performance and material quality reforming performance are improved. As a wide range of choice in production means is assured as compared with the knwon batch system, this ball mill contributes to development and production of new functional materials.

2 Claims, 5 Drawing Sheets

CONTINUOUS TYPE VERTICAL PLANETARY BALL MILL

BACKGROUND OF THE INVENTION

1. Field of the Invention

The present invention relates to a ball mill and, more particularly, to a planetary ball mill of the continuous type, in which a mill pot is fitted inside a mill casing, and fine crushing or pulverization is performed while crushing mediums together with a material to be crushed are sealed.

2. Prior Art

In a planetary ball mill of conventional construction, a plurality of mill pots evenly disposed around a main shaft (i.e., symmetrically in case of two mill pots, or radially from the main shaft with equal distance in case of three mill pots) revolve with the rotation of the main shaft, and these mill pots themselves rotate around their own axis. In the vertical type of planetary ball mill, which in principle is schematically shown in FIGS. 5(A) and (B), the driving force of a motor 6*a* is transmitted to a main shaft 22*a* through a sprocket 61*a* and a transmission chain 62*a*. A rotary shaft 101 attached to the mill pot 31*a* is rotatably mounted on a mill body fixed to the main shaft. In the meantime, a sun sprocket 71*a* fixed onto the same axis as the main shaft so as not to rotate and a planetary sprocket 24*a* disposed on the rotation shaft are connected to each other by way of a transmission chain so that the mill pot, fixed to the rotary shaft, is turned around by causing the rotary shaft to rotate and revolve.

When putting a crushing medium B and a material S to be crushed in the same mill pot and driving the motor, the mill pot 31*a* rotates and revolves, whereby the crushing medium performs its proper motion by centrifugal acceleration and crushes the material to be crushed. More specifically, in the rolling ball mill of the conventional type, the ball-shaped crushing medium and the material to be crushed bring about a cascade motion in a rolling cylinder, and the material is crushed as a result of collapse and abrasion due to gravitational drop of the crushing medium. On the other hand, in the planetary ball mill, the crushing speed is remarkably improved by the mutual cooperation between the centrifugal force due to the high speed revolution and rotation and the Coriolis force, whereby fine particles excellent in distribution of particle size can be obtained in a rather short time. In particular, the crushing force due to high speed rotation is remarkable such that, for instance, when putting silica sand of several milimeters in grain size in the mill pot, fine particles of several microns in average size can be obtained just after operating the mill for only a few minutes. When completing the crushing operation, only the mill pot is removed to pick up or recover the produced fine particles from the mill pot.

Other vertical type planetary ball mills have also been heretofore proposed. That is, in the Japanese Laid-Open Patent Publication (unexamined) No. 5-146698, a mill body is formed of a disk, and a mill pot is engagedly fitted in a hole provided through the disk to increase rigidity. In the Japanese Laid-Open Patent Publication (unexamined) No. 4-40245, a hollow part is provided between the mill housing and the mill pot so as to cause a cool or hot fluid to circulate through the hollow part thereby adding a temperature function regulation to the mill. Further, in the Japanese Laid-Open Utility Model Publication (unexamined) No. 4-17837, a planetary ball mill of small noise type is proposed in which the driving force is transmitted to a rotary shaft and a revolving shaft by way of a driven flexible endless belt.

In most of the prior art proposed in the form of a vertical type planetary ball mill, a batch system is employed, and the fact is that there is substantially no continuous system though it is employed in most of the horizontal planetary ball mills. In the batch system, once any material to be crushed is placed in a mill pot, the material is subject to a required crushing operation for a required time by hermetically closing the mill pot with a cover. This means that the batch type may be suitable for small scale crushing, such as experimental crushing, but that it is difficult to free it from the influence of gravity during large scale crushing operation because the mill pot is arranged vertically. As a result, in the batch type, after repeating the same manner of operations continuously for a long time under the sealed state, there arises a disadvantage of particle size nonuniformity or unevenness depending upon the location of the material inside the mill pot. Moreover, when chemical reaction of the material is intended, in addition to crushing, there may arise a further disadvantage of nonuniformity in the quality of the crushed material. As far as uniformity of quality and particle size is concerned, it seems that the continuous circulation type is significantly advantageous because, in this type, it is possible to limit the crushing and reaction time in the mill pot, and recycle (feed again) an intermediate product to the same mill pot. Furthermore, in the conventional vertical ball mill not employing the continuous circulation system, there is a further disadvantage in that the material treated in the mill pot must be discharged for each treatment and then another new material to be treated must be supplied. This leads to troublesome manual work resulting in a considerable influence on efficiency or productivity.

Notwithstanding the above, no continuous vertical planetary ball mill type has been proposed up to today. This is because, in the construction of the vertical type, it is an essential requirement that the strength of the rotating shaft is high as compared with the horizontal type since the rotary shaft is supported as a cantilever in the vertical type while it is supported at the center from two sides in the horizontal type. Moreover, in the horizontal type, it is possible to uniformly and constantly supply the mill pot with material at all times and selectively recover only the fine particles crushed to a required partical size from among the treated material by utilizing continuous air-swept communication to a final bag filter. On the other hand, in the vertical type, there exists an additional problem of gravity, which has never been solved in the prior art.

SUMMARY OF THE INVENTION

As mentioned above, however, it is still strongly demanded that a vertical planetary ball mill be formed into a continuous type, in view of the mentioned advantages of obtaining uniform products, accelerating rationalization of crushing and quality improving processes.

It is, therefore, an object of the present invention to solve the above-discussed problems by providing a continuous type planetary ball mill in which not only is superior working performance achieved but also crushed products of high quality are obtained.

To accomplish the foregoing object, a continuous type vertical planetary ball mill according to the present invention comprises a revolving rotary body 2 which is vertically supported and revolves, and a plurality of rotating mill pots 31 which are vertically disposed evenly on the rotary body 2 and rotate, characterized in that each of the mill pots 31 has an entrance 35 provided through an upper side thereof and an exit 36 provided through a bottom side thereof to allow only fine particles to pass therethrough, and the entrance 35 communicates with a charging port 11 of a charging case (hopper) 1 rotating together with the revolving rotary body 2 while the exit 36 communicates with a discharging case 4 fixed onto a bed 5.

In the above construction, it is preferable that a sun gear 71 engaging a planetary gear 24 is fixed to an upper end of a mill casing 3, which is fixed to an upper end of a fixed shaft 7 vertically mounted on the bed 5. It is also preferable that an airtight (sealed) chamber 76 communicating with an outside compressed air source is provided between the fixed shaft 7 and a rotary shaft 22. The airtight chamber communicates directly or by way of through holes 28, 29 for injecting compressed air to bearings 72, 73, 25, 26 which are respectively disposed between the sealed chamber and the fixed shaft, between the sealed chamber and the rotary shaft, and between the sealed chamber and the mill casing. It is further preferable that a conical member 38 provided with a number of slits 37 is mounted at the exit 36 of the mill pot.

In the vertical planetary ball mill of the above construction, the material S to be crushed, which has been charged through the upper part of the charging case 1, is moved toward the circumferential side due to a centrifugal force produced by the revolution together with the rotary body 2, and then supplied through the entrance 35 into the mill pot 31. Then, a basic operation is performed such that after being crushed and/or reformed in the mill pot, only fine particles of a desired particle size are selectively picked up and discharged to the discharging case 4 to be recovered to the outside.

During such a basic operation, the rotary body 2 is vertically pivoted on the bed 5 together with the charging case 1 and, in the upper part, the sun gear 71 mounted on the fixed shaft 7 is engaged with the planetary gear 24 mounted on the mill casing 3 which is stably held between upper and lower rotary parts 21, 23 of the rotary body, whereby a high speed operation of the mill can be safely performed.

Since the hollow sealed chamber 76 is provided between the fixed shaft 7 and the rotary shaft 22 to constantly compressed air to the bearing parts connecting the rotating section to the non-rotating section, an air flow different from the material flow performs a sealing function for the shaft to inhibit the material from entering into the bearing parts, resulting in protection of the bearings of the respective parts.

The continuous type vertical planetary ball mill according to the present invention is stable in construction as compared with the vertical type according to the prior art and enables a high speed operation in which equivalent centrifugal acceleration is largely increased as compared with the prior art. As a result, the technical advantage of improving crushing efficiency as well as material quality reforming efficiency is achieved. In other words, the working performance is remarkably high as compared with the conventional batch type, and uniform and reliable products of high quality can be assured at all times. Furthermore, automation of the mill sysystem can be easily achieved since the mill according to the present invention is formed into a continuous type. It is also possible to modify the ball mill into a circulation type, when required, to establish a system for repeating the operation until obtaining an intended quality and/or particle size. This production system cannot be achieved by the batch type as a matter of course, and therefore it is to be expected that the ball mill according to the present invention contributes largely to development and production of new functional materials. As for the advantages during operation, since the material charging port is vertically provided at the center of the upper part, although the ball mill according to the present invention is a relatively small apparatus, a large amount of materials to be crushed can be continuously supplied to the mill pot with the assistance of gravity. Furthermore, since the entrance of the mill pot is provided on the upper part, there is no possibility that material to be crushed (crushing medium) can get out of the mill pot during the period of suspension of the ball mill, despite the fact that the opening area of the entrance is large, thus permitting the operator to be free from troublesome works.

Other objects, features and advantages of the present invention will become apparent in the course of the following description with reference to the accompanying drawings.

DESCRIPTION OF THE PREFERRED EMBODIMENT

Figure 1:
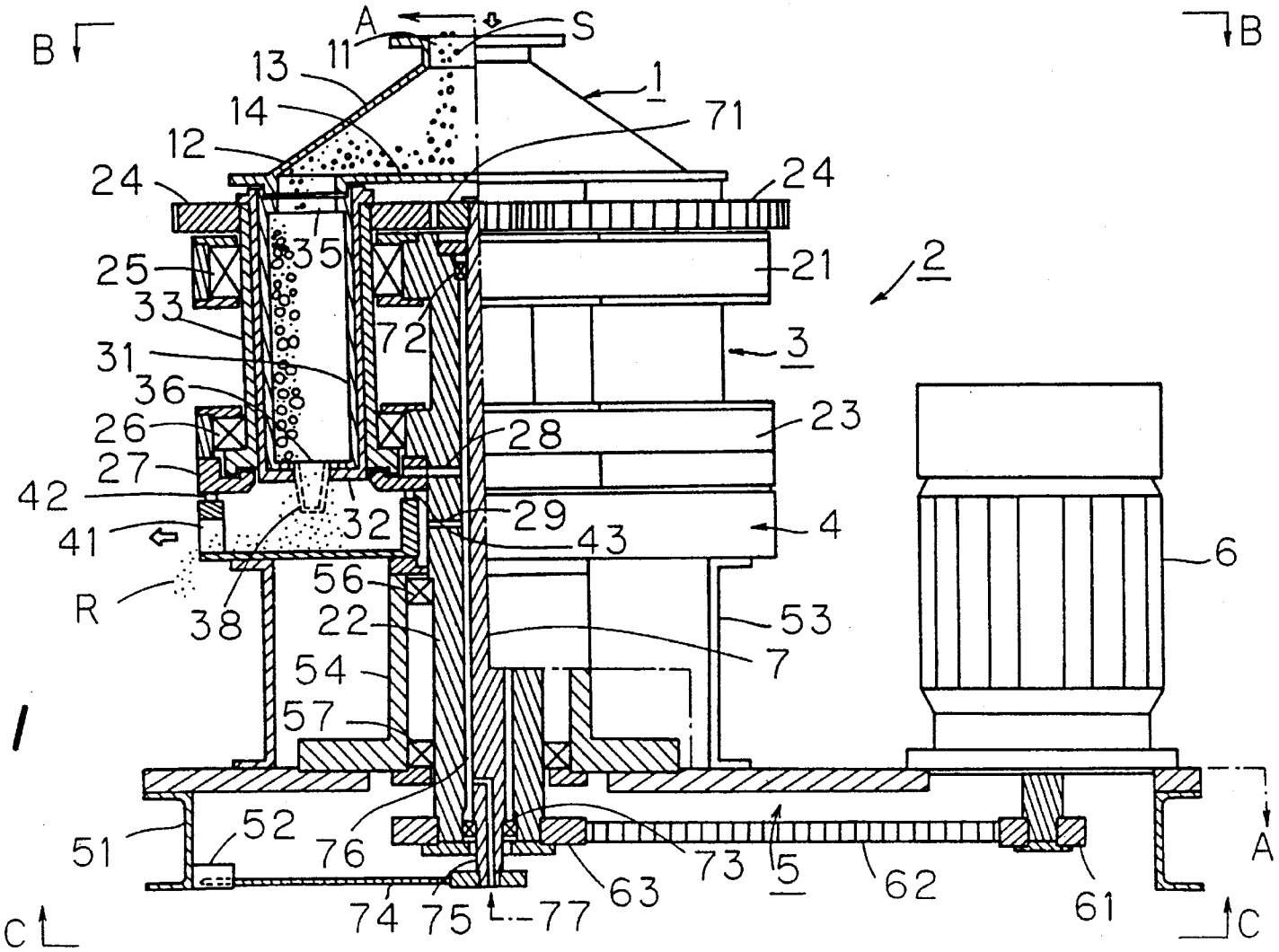
FIG. 1 is a longitudinal sectional front view of a continuous type vertical planetary ball mill according to one embodiment of the present invention.
Figure 2:
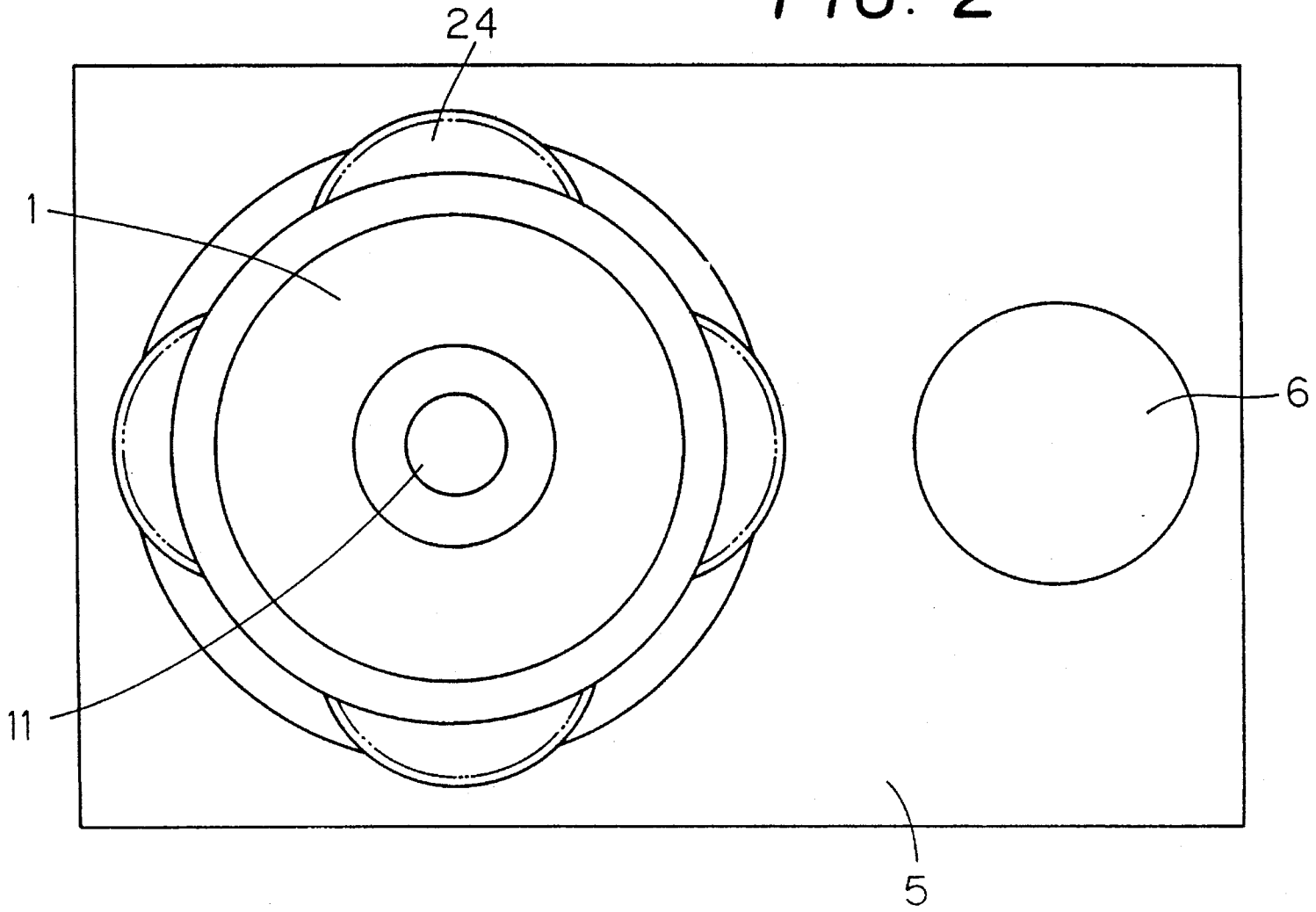
FIG. 2 is a sectional view taken along the line B—B in FIG. 1.
Figure 3:
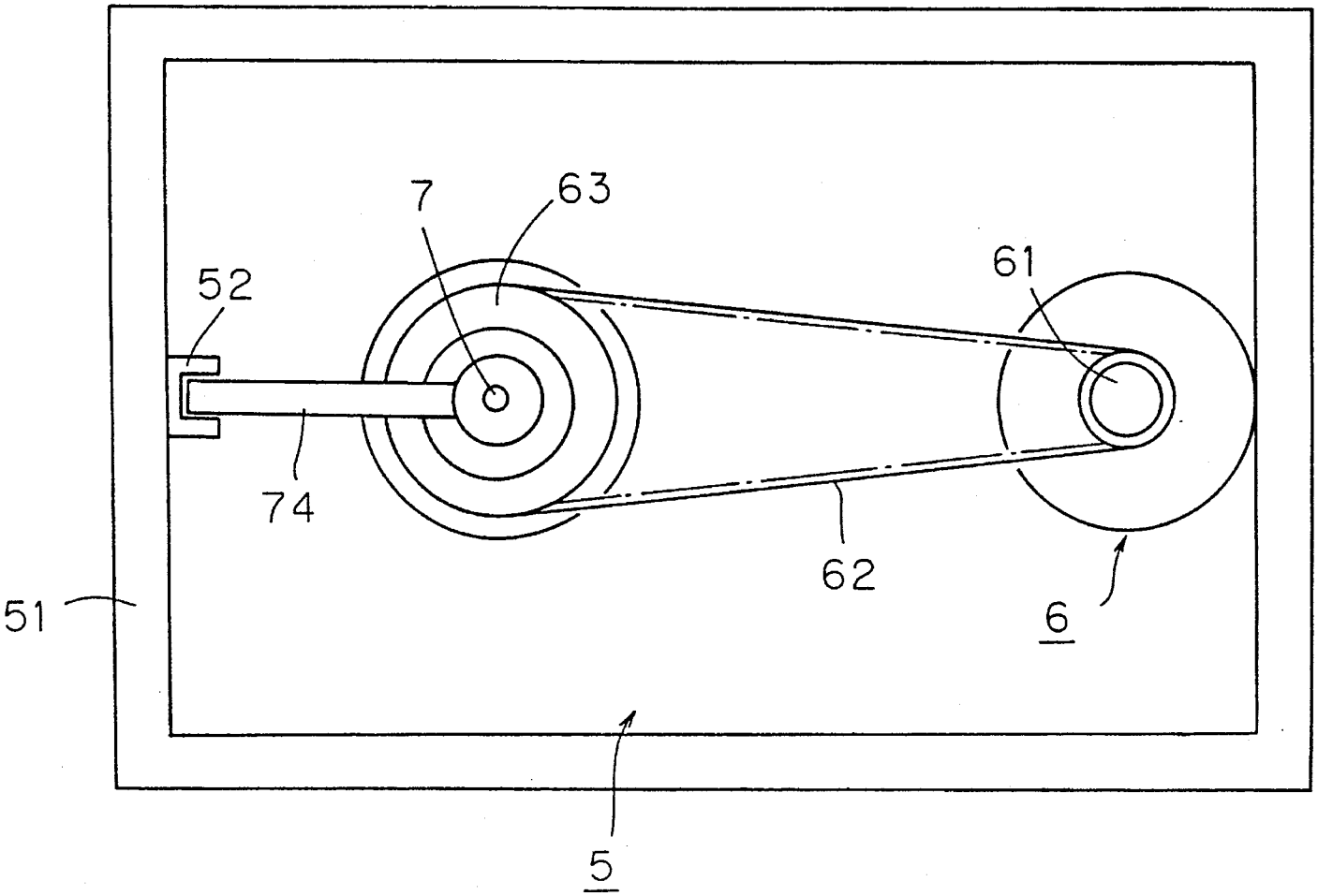
FIG. 3 is a sectional view taken along the line C—C in FIG. 1.

FIG. 1 shows a longitudinal sectional view according to one embodiment of the present invention, FIG. 2 shows a sectional view taken along the line B—B, and FIG. 3 shows a sectional view taken along the line C—C. Referring to these drawings, an entire apparatus is put on a bed 5, whereby a mill body formed around a drive unit 6 as well as around a fixed shaft 7 is supported thereon. When starting the drive unit 6, a pulley 61 is rotated, which causes a pulley 63 fixed to a rotary shaft 22 on a planetary ball mill side to rotate by way of a belt 62. The rotary shaft 22 is vertically pivoted by bearings 56 and 57 on a supporting member 54 mounted on the bed 5 and causes the rotary body 2 to revolve.

In this connection, the rotary body 2 refers collectively to a whole part revolving together with the rotary shaft 22 and comprises a charging case 1, an upper part 21 of the rotary body, a mill casing 3, and a lower part 23 of the rotary body. The charging case 1 includes a conical inclined surface 13 and has a charging port 11 opened at the top of the center part and an opening 12 communicating at a predetermined position with a mill pot 31 supported vertically downward from a bottom face 14 of the charging case.

The mentioned upper part 21 and the lower part 23 of the rotary body 2 are each formed into a disk. A plurality of through holes are provided on the circumference of each disk by dividing the circumference into even parts. Then, upper bearing 25 and lower bearing 26 are respectively inserted in those through holes. An external cylinder 33 is fitted to the internal diameter side of each bearing, and the mill pot 31 is attached closely to the further inside though an intermediate cylinder 32. The external cylinder 33 of the mill casing extends upwardly from the upper part 21 of the rotary body, and the planetary gear 24 is mounted on the outer periphery of the extending part and engages with a sun gear 71 mounted on an upper end of the fixed shaft 7. In this manner, the mill casing, i.e., mill pot revolves by receiving the rotation of the rotary body 2 and, at the same time, is rotated on its own vertical axis for relative motion of the planetary gear engaged with the stationary sun gear of the fixed shaft. Thus, the mill casing, i.e., mill pot revolves by receiving the rotation of the rotary body and, at the same time, rotates around its own vertical shaft as an axis by receiving a relative motion of the planetary gear engaged with the stationary sun gear mounted on the fixed shaft.

Figure 4B:
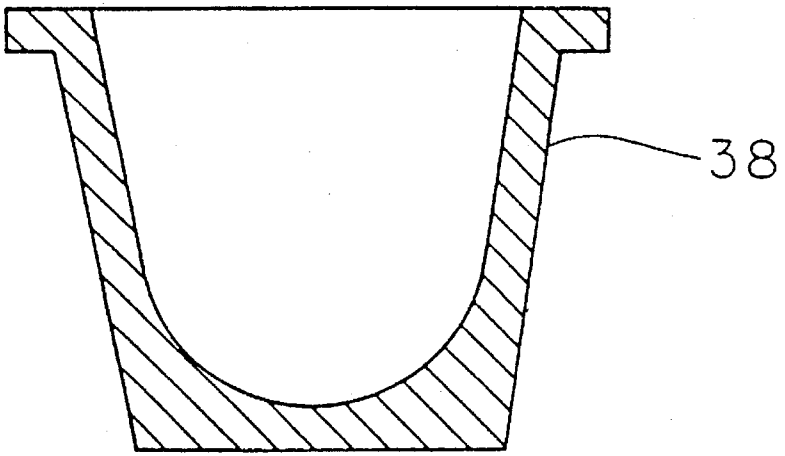
FIGS. 4(A) and (B) are respectively a front view and a longitudinal sectional front view of the conical member 38.
Figure 4A:
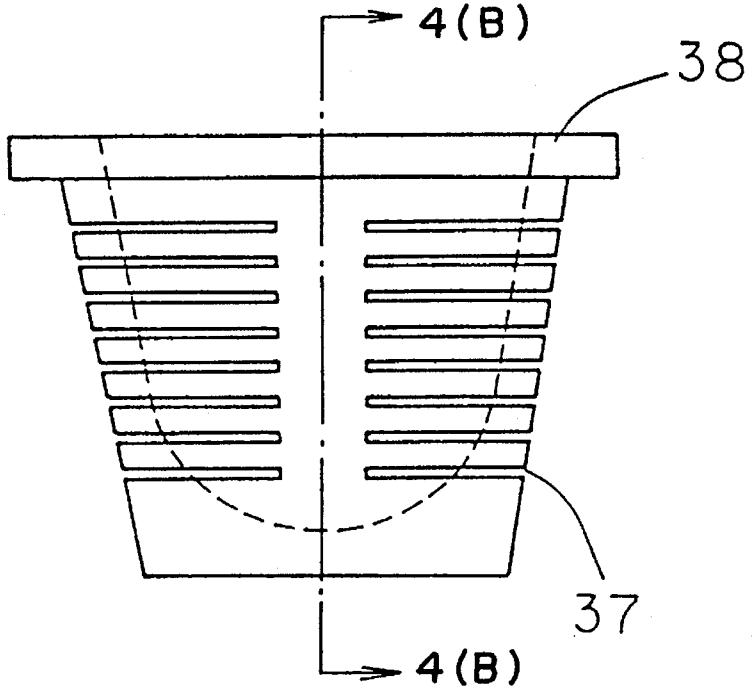
Figure 5B:
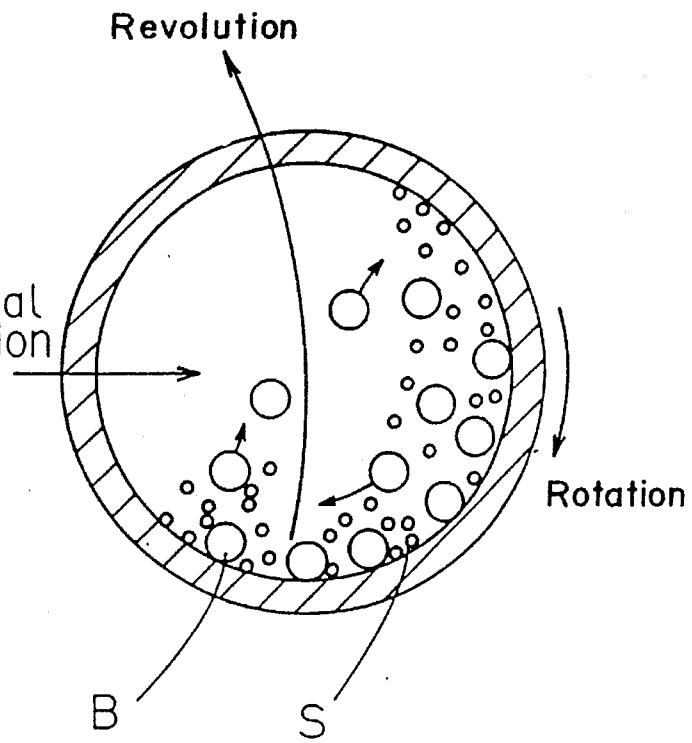
FIGS. 5(A) and (B) are respectively a front view illustrating an example of a vertical planetary ball mill according to the prior art, and a sectional view of the mill pot thereof.
Figure 5A:
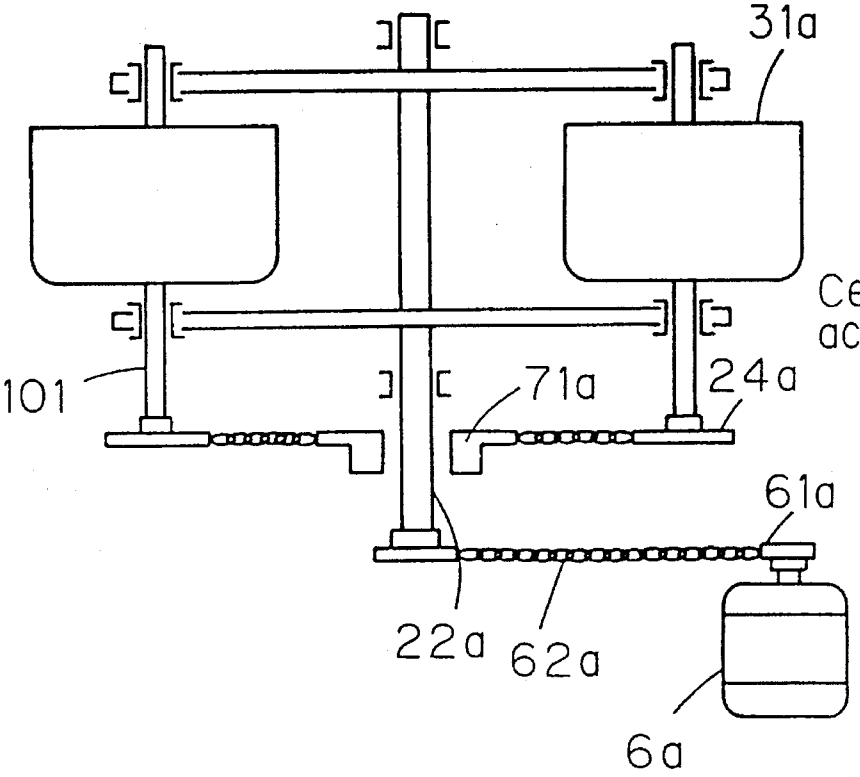

On the upper part of the mill pot 31, the entrance 35 is in open communication with the charging port 11, whereby the material to be crushed supplied to the charging case is guided into the mill pot. In the mill pot, crushing mediums (balls) B of superior abrasion resistance are put together with the material to be crushed, and centrifugal force and Coriolis force are applied to these crushing mediums and material to be crushed so as to cause an equivalent centrifugal acceleration, about 100 times as large as gravitational acceleration, to act on them, whereby an intended fine crushing and quality improvement (reformation) are efficiently proceeded. On the lower part of the mill pot, the exit 36 is open, and the conical member 38 provided with a number of slits 37 (seen clearly in FIG. 4) is engaged with the opening part of the exit, so that only the material crushed to a required particle size may be discharged downward through the slits and recovered through the discharging port 41 opened on one side of the discharging case 4 mounted on the supporting member 54 and bracket 53 to the outside.

A seal ring 27 is disposed on the bottom part of the rotary body 2, and rubber rings 42, 43 are inserted between the seal ring and the top face of the discharging case 4 which is the highest upper part of the nonrotating section so that the interior part of the discharging case is kept airtight and the obtained products are prevented from flying out. A fixed lever 74 is connected to the lower end of the fixed shaft, and the top of the lever is held horizontally in a holder attached to a frame 51 to be retained therein for preventing the fixed shaft from turning.

An airtight chamber 76 is provided in a hollow part formed between the fixed shaft 7 and the rotary shaft 22. This airtight chamber communicates, on one hand, with a compressed air supply port 77 provided vertically through the shaft center of the fixed shaft so as to be open to the outside and, on the other hand, communicates respectively to the bearings 72, 73, 25, 26 directly or by way of the through holes 28, 29 provided through the peripheral wall of the rotary body 2, whereby sealing air is supplied to respective bearings by receiving compressed air through the supply port 77. As the material to be crushed moving inside the rotary body cannot enter the bearings against the flow of this sealing air, the bearing parts are kept clean. As the mill casing 3 and the seal ring 27 are formed into a non-contact seal construction of less rotational resistance, air flow is blown into the discharging case 4 and discharged therefrom through the discharging port 41 together with a powder (final product) R. In this connection, it is also preferable that powder and air are discharged by forced suction by coupling a suction port to the discharging port 27.

While a preferred embodiment has been described, changes and variations may be made without departing from the spirit or scope of the appended claims.

What is claimed is:

1. A continuous type vertical planetary ball mill, comprising:

a bed;

revolving means;

a vertically supported revolving rotary body mounted to said bed to revolve on said bed and rotate relative to said bed, said revolving means being operatively disposed relative to said bed to rotate said vertically supported revolving rotary body, wherein said vertically supported revolving rotary body includes: a plurality of mill pots vertically disposed evenly on said vertically supported revolving rotary body for rotation relative thereto; a charging case defining a charging port and a discharging case, and wherein each said mill pot is mounted so as not to be cantilevered and includes an entrance at an upper side thereof in communication with said charging port, and an exit at a bottom side thereof in communication with said discharging case, thereby allowing only fine particles to pass through each mill pot;

a fixed shaft extending upwardly from said bed;

a mill casing;

a planetary gear mounted to each mill pot;

a sun gear mounted to an upper end of said fixed gear and engageable with each planetary gear;

a rotary shaft;

bearing means mounting said rotary shaft to said fixed shaft; and further bearing means mounting each mill pot to said rotary shaft, wherein said rotary shaft defines an airtight chamber between it and said fixed shaft, wherein said fixed shaft includes a passage extending into said airtight chamber for communicating compressed air to said bearing means, and wherein said rotary shaft defines at least one through hole for communicating compressed air to said further bearing means.

2. The continuous type planetary ball mill as defined in claim 1, further comprising:

a conical member provided with a plurality of slits, said conical member being mounted at said exit of each of said mill pots.

* * * * *